US005595236A

United States Patent [19]

Lee et al.

[11] Patent Number: 5,595,236

[45] Date of Patent: Jan. 21, 1997

[54] VERTICAL SQUEEZE CASTING APPARATUS

[75] Inventors: Ho-In Lee; Ki-Bae Kim; Yo-Sub Han; Yong-Joon Kim, all of Seoul, Rep. of Korea

[73] Assignee: Korea Institute of Science and Technology, Seoul, Rep. of Korea

[21] Appl. No.: 436,484

[22] Filed: May 8, 1995

[51] Int. Cl.[6] ..... B22D 17/00; B22D 17/04

[52] U.S. Cl. ..... 164/319

[58] Field of Search ..... 164/120, 319, 164/312, 320, 113

[56] References Cited

U.S. PATENT DOCUMENTS 4,446,907 5/1984 Suzuki et al. ..... 164/120

FOREIGN PATENT DOCUMENTS 59-45071 3/1984 Japan ..... 164/113

2-263555 10/1990 Japan ..... 164/319

3-142054 6/1991 Japan .

4-143060 5/1992 Japan ..... 164/312

*Primary Examiner*—Joseph J. Hail, III

*Assistant Examiner*—I.-H. Lin

*Attorney, Agent, or Firm*—Oblon, Spivak, McClelland, Maier & Neustadt, P.C.

[57] ABSTRACT

An apparatus for vertical squeeze casting, which alters conventional apparatuses for vertical squeeze casting using squeeze casting methods to manufacture highly-detailed cast products of high quality by locally pressing the molten metal injection filled into the metal mold cavity, by improving the molten metal supplying mechanism and cast product extraction method, so that local pressing of the cast product from all vertical and lateral directions is enabled, thereby enabling the production of cast products with many variations in thickness and complex structures.

6 Claims, 4 Drawing Sheets

VERTICAL SQUEEZE CASTING APPARATUS

BACKGROUND OF THE INVENTION

1. Field of the Invention

A squeeze casting method is a casting method wherein, by directly applying high pressure produced by a mechanical means such as hydraulic press to the molten metal in the metal mold cavity, the molten metal is statically pressed to an internal or other space, thereby effecting solidification of the molten metal. The method can produce high quality products by limiting the formation of the casting defect by an application of high pressures during the solidification process. Generally, it is a high pressure casting solidification method which is also denoted by the term "molten metal forging method".

Thus, the squeeze casting method is a composite forming method which combines the press forging method to the solidification shrinkage process where irregular changes in volume occur due to the changes from the liquid phase to the solid phase. In this method, by applying high pressure during the solidification, the molten metal is sufficiently supplied for the shrinkage cavity caused by the solidification shrinkage when the molten metal is solidified during press forming. Further, the pin hole and gas porosities are eliminated by the increase in the dissolution limit of the hydrogen gas, and the molten metal is tightened with the metal mold to limit the formation of the air gap (the empty space formed where the casted metal is separated from the metal mold surface). Therefore, the cooling rate of the cast product is increased, thereby allowing the formation of more fine structures, and thus improving the mechanical properties. Also, this method is a casting method which can produce high density and high quality cast products without any casting defects, such as air gap by injection filling the molten metal into the metal mold cavity at low speeds, thereby eliminating a phenomena such as mixing of the solidified layer or air in the injection sleeve and the metal mold cavity in the molten metal.

2. Description of the Prior Art

The squeeze casting method, according to the method used to apply high pressures to the molten metal during the manufacturing of cast products, can be classified into the three following methods which were known in the prior art. The prior art methods are the direct pressing method (FIG. 5A), the indirect pressing method (FIG. 5B), and the local pressing method (FIG. 5C).

The direct pressing method, as shown in FIG. 5A, is method of directly applying pressure by using an upper pressing plunger to the molten metal poured into the metal mold cavity. This method was most often used when the squeeze casting method was first developed. In this method, the transfer efficiency of the pressure force is very high since the pressure from the pressing plunger is delivered directly to the molten metal inside the metal mold cavity, giving maximum impact to the pressing effect. Thus, solidification occurs rapidly since the tightness between the molten metal and the metal mold is increased. The mechanical characteristics are greatly increased since the production of the metal with a high dense and fine structure are accomplished by eliminating the casting defects caused by solidification shrinkage or air. Also, high dimensional accuracy and good surface profile can be obtained, allowing the manufacturing of high quality cast products. However, the pressing displacement of high pressures is determined by the amount of molten metal poured into the metal mold cavity. In other words, if the poured amount of the molten metal is small, the size of the cast product is less than desired; and if the poured amount of the molten metal is large, the size of the cast product is larger than desired. Thus, it is imperative that the pouring amount of the molten metal be accurate. However, it is very difficult to determine the correct or accurate pouring amount of the molten metal in actual practice. Although it is possible to use an automatic pouring device with a sensor for measuring the height of the molten metal, such a device is extremely expensive.

The indirect pressing method, as shown in FIG. 5(B), is a pressing method where a connecting runner is installed to the metal mold cavity within the metal mold, thereby pouring the molten metal onto a portion of the runner and metal mold cavity, afterwards advancing the upper pressing plunger to inject the molten metal in the runner at low speeds into the metal mold cavity, and thereafter using a pressing plunger to apply high pressure to the molten metal in the runner, thereby effecting solidification of the molten metal in the metal mold cavity. In the indirect pressing method, since extra part of the poured amount collects at the runner, the dimensions of the cast product are not affected by any change in the poured amount and thus, the accuracy in the poured amount is not required. However, the pressure transfer efficiency is lower than that in the direct pressing method since the high pressure from the pressing plunger is not directly delivered to the molten metal in the metal mold cavity, but delivered through the molten metal in the runner. Thus, this results in a reduction of mechanical properties from the reduction in pressing effect. Particularly, in the case of cast products which have complicated structures and many variations in thickness, the solidification time of the molten metal in the metal mold cavity differs according to the thickness of the product. That is, while the portion of the product in the metal mold cavity with a thin thickness solidifies quickly, the thick portions solidify at a later point. Accordingly, while the portion with a thin product thickness near the runner will have already solidified, if the thick portions in the metal mold cavity are far from the runner, the pressure force from the pressing plunger will not be delivered to the incompletely-solidified thick potions. The effects of the pressure applied will not appear in the product portions with a thick thickness, causing casting defects.

To solve the above disadvantages of the indirect pressing method, Japanese patent publications Sho 49-36093 and Sho 59-30503, as shown in FIG. 5C, propose a local pressing method, wherein a pressing plunger is installed at the thick portions where the pressing effect is expected to be low, and an injection plunger is used to fill the molten metal into the metal mold cavity, afterwards forwardly pressing the pressing plunger towards the metal mold cavity, increasing the pressing effect at the portions where the pressing effect is expected to be low, thereby maximally increasing the pressure transfer efficiency. Such a local pressing method does not require an accurate poured amount of the molten metal, and the pressing effect can be applied to all portions of the cast product. Thus, this method is very useful for manufacturing cast products with complex structures and many variations in thickness.

In producing cast products using a squeeze casting apparatus using the above local pressing method, there are circumstances which require pressure to be applied from all vertical and lateral directions, especially for cast products such as housings which have complicated structures and many variations in thickness.

However, for prior art squeeze casting apparatus, aside from the lateral pressing means to effect the lateral pressing to the molten metal supplied to the metal mold cavity; other means, such as a molten metal supplying means to fill the molten metal into the metal mold cavity and the runner, and an extraction means to extract the completed cast product from the metal mold cavity, must be installed at a position vertical or lateral to the metal mold. Thus, it is difficult to install the pressing plungers which can effect lateral pressing to all vertical and lateral directions to the metal mold.

SUMMARY OF THE INVENTION

This invention relates to an apparatus for vertical squeeze casting. In particular, the present invention is directed towards the manufacturing of highly detailed and high quality cast materials by locally pressing the molten metal which has been filled in the metal mold cavity; and more specifically, is directed towards an apparatus for vertical squeeze casting which can apply a local pressing force in all vertical and lateral directions towards the metal mold.

The present invention, to solve the above problems and disadvantages of the prior art vertical squeeze casting apparatus, does not separately install an extraction means to extract the completed cast product from the metal mold cavity as in the previous vertical squeeze casting apparatus, and appropriately uses the upper and lower pressing plungers to extract the solidified cast product from the metal mold. Further, the present invention provides the molten metal supplying means which comprises a runner installed at an angle of 45 to 55 degrees in a vertical direction from the metal mold abutting surface and a molten metal pool located at the end portion of the runner. The molten metal is supplied to the runner by the use of gravity, and a laterally pressing plunger movable through the downwardly movable metal mold is provided at the side of the downwardly movable metal mold. Thus, a vertical squeeze casting apparatus which enables local pressing from all vertical and lateral directions is provided.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
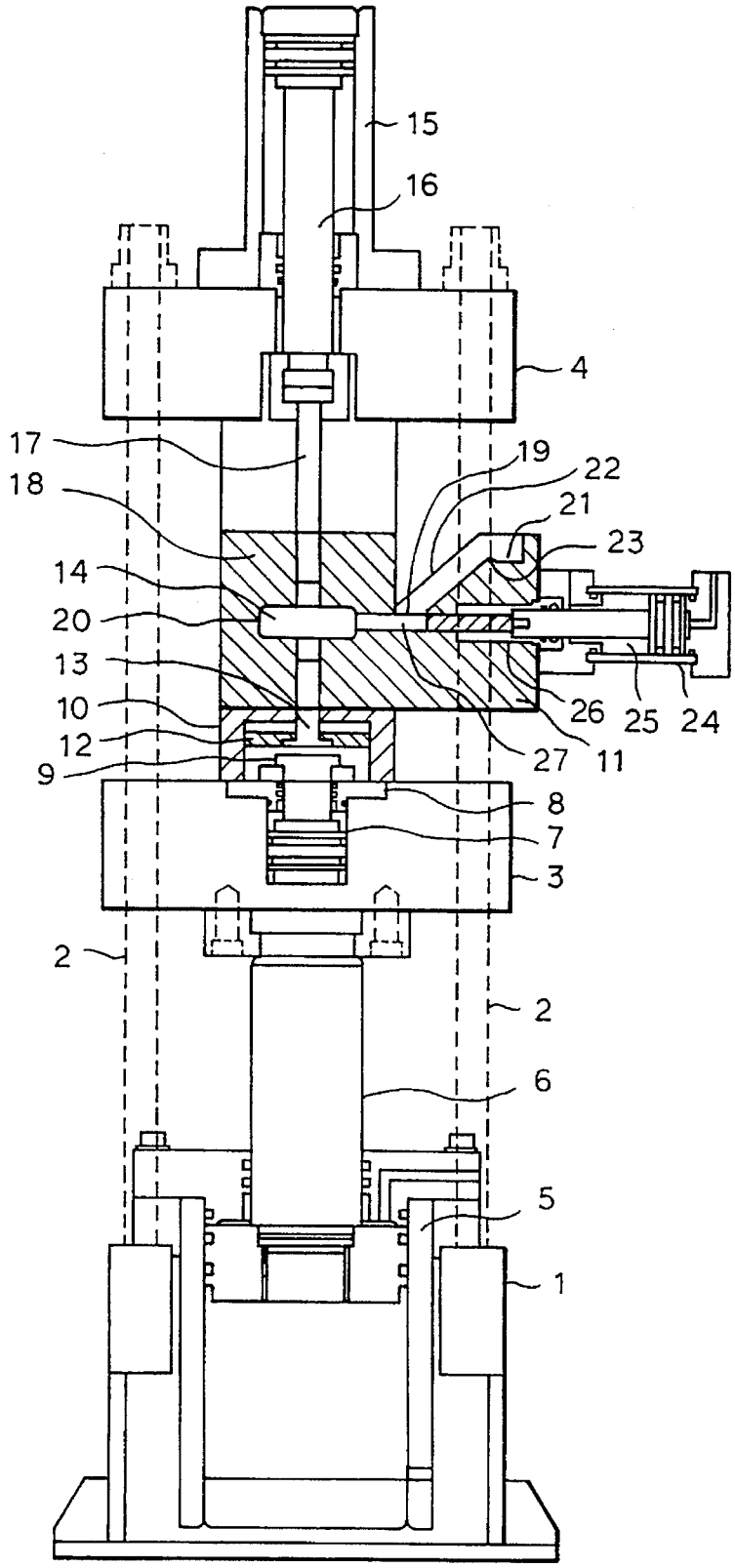
FIG. 1 is a vertical sectional view of the casting apparatus according to the present invention, schematically showing the whole structure thereof.

According to the preferred embodiment of the present invention, an apparatus for vertical squeeze casting is provided where pressure may be applied to all vertical and lateral directions and where the completed cast product may be extracted from the metal mold without a separate extraction means. That is, to extract the solidified cast product from the metal mold cavity, as the metal mold is moving downwardly, the lower pressing plunger is raised by approximately 5 mm at the same movement speed as that of the lower pressing plunger. Thus, the cast product is separated from the downwardly movable metal mold but remains affixed to the upper fixed metal mold by the lower pressing plunger. Afterwards, the lower pressing plunger is lowered and the upper pressing plunger is raised to separate the two pressing plungers from the cast product to separate and extract the cast product from the fixed metal mold.

Another advantage of the present invention is that the molten metal supplying means may be eliminated by installing a semi-circular runner to the lower movable metal mold from the center of the line formed by the meeting of the lateral side of the upper fixed metal mold and the split plane of the metal mold, at an angle of 45 to 55 degrees towards the upper direction from the split plane. At the end of the runner, a molten metal pool is installed so that the molten metal is supplied to the runner by means of gravity. Further, a lateral pressing plunger, passing through the lower movable metal mold, is installed at a line extended from the split plane formed by the meeting of the upper fixed metal mold and the lower movable metal mold, towards the lateral side of the lower movable metal mold. Thus, the molten metal in the runner may be pressed and injection filled into the metal mold cavity, allowing lateral pressing.

Another advantage of the present invention is that an apparatus for vertical squeeze casting which allows the local pressing of the molten metal to be filled into the metal mold cavity for the production of high quality and high density cast products with complex structures and many variations in thickness is provided. This apparatus for vertical squeeze casting may provide the following functions.

1. It may locally press the molten metal in the metal mold cavity from all vertical and lateral directions so that the maximum pressing effect may be imparted to the cast product from all directions.

2. To enable the above local pressing, the upper pressing plunger effects pressing and extraction.

3. To extract the cast product, after the molten metal in the metal mold cavity is completely solidified, as the lower metal mold starts moving downwards, the lower pressing plunger is raised slightly upwards so that the completely solidified cast product is separated from the lower movable metal mold but remains affixed to the upper fixed metal mold. Afterwards, the upper pressing plunger is raised to separate it from the cast product, and the lower pressing plunger is then lowered to separate the cast product from the fixed metal mold and extract it from the metal mold.

4. To locally press the molten metal in the metal mold cavity from vertical and lateral directions, a runner is laterally installed so that the molten metal flows into the runner by means of gravity and afterwards, by using the lateral molten metal supply and pressing plunger, the molten metal supply as well as the lateral local pressing is enabled.

5. Closing of the runner is enabled by moving the molten metal supply and pressing plunger.

The apparatus for vertical squeeze casting of the present invention is described in detail below using the accompanying figures.

As shown in FIG. 1, in the apparatus for vertical squeeze casting of the present invention, a securing means 1 is installed on the floor of the work space using an anchor bolt. Four cylindrical tie bars 2 are vertically securely installed at each corner at the top of the securing means 1. The tie bars 2 pass through the corner of a movable metal mold support 3 and a fixed metal mold support 4. The fixed metal mold support 4 is securely affixed to an upper portion of tie bar 2. As shown, movable metal mold support 3 is installed between the securing means 1 and fixed metal mold support 4, so as to enable vertical movement of this movable metal mold, the movement being guided by the four tie bars 2.

Further, for the movement of the movable metal mold support 3, a hydraulic cylinder 5 for engaging the dies is securely installed inside the securing means 1. This hydraulic cylinder 5 surrounds a cylindrical metal mold engaging piston 6 and receives the pressing force from a hydraulic pipe (not shown in the figures) located at the top of the hydraulic cylinder 5. The piston 6 can produce a maximum pressure of 200 tons, and move vertically in the hydraulic cylinder 5 by a maximum displacement of 300 mm. Since the metal mold engaging piston 6 is secured on a movable metal mold support 3 by means of a six-sided socket head bolt, change in the movement of metal mold engaging piston 6 will be delivered through tie bar 2 to effect a simultaneous change in the movement of movable metal mold support 3.

Additionally, a cylindrical T-shaped thick groove is provided on the center of the movable metal mold support 3. To activate the lower pressing cylinder 7 using said groove, the upper plate 8 of the lower pressing cylinder is completely inserted into the wide groove on the left hand side of the T-shaped groove and securely installed on the movable metal mold support 3 by means of a six-sided socket head bolt so that the upper surface of the movable metal mold support 3 will be flat. A hole is provided in the center of an upper plate 8 of the lower pressing cylinder, so that the closely associated movement of lower pressing piston 9 is possible through said hole. Thus, in the closed space within lower pressing cylinder 7 formed by movable metal mold support 3, upper plate 8 of the lower pressing cylinder, and the lower pressing piston 9, a maximum pressure of 30 tons is applied through a hydraulic pipe (not shown in the figures) to move lower pressing piston 9 a maximum of 20 mm.

Additionally, reference numeral 10 shows a moveable metal mold supporting means secured on the movable metal mold support 3, securing and supporting the movable mold 11 and transferring the movement of movable metal mold support 3 to movable mold 11. Inside a movable metal mold supporting means 10, a lower pressing plate 12 is installed so that the said plate's vertical movement is allowed. The lower pressing plate 12 is comprised of two plates, where the lower plate is securely connected to lower pressing piston 9 through a screw hole formed on a lower surface of the lower plate. At the same time, a groove is provided on the lower surface of the lower plate so that the head portion of lower pressing plunger 13 is secured between the upper and lower plates. Thus, said two plates are connected with a six-sided socket head bolt not shown in the figure so that the movement of lower pressing piston 9 is directly delivered through said lower pressing plate 12 to lower pressing plunger 13. As seen from the above, the reason for installing lower pressing plate 12 is to allow the use of multiple lower pressing plungers (13), thereby applying pressure to various points of the poured molten metal in mold cavity 14.

Further, upper pressing cylinder 15 is securely installed on top of the fixed metal mold supporting means 4. Said upper pressing cylinder 15 surrounds the internal cylindrical upper pressing piston 16 and uses a maximum pressure of 40 tons, through a hydraulic pipe (not shown in the figures), to move said piston 16 a maximum of 80 mm in the vertical direction on the figure. Also, since upper pressing piston 16 is connected to upper pressing plunger 17, the change in movement of upper pressing piston 16 is transferred to upper pressing plunger 17, after the molten metal is filled into metal mold cavity 14, said plunger 17 moves forward, towards metal mold cavity 14 and applies pressure to the molten metal. Afterwards, when extracting the completely solidified cast product in the metal mold cavity 14, said upper pressing plunger 17 is elevated to separate from the cast product and by lowering said plunger 17, the cast product is extracted from the fixed metal mold.

Figure 2A:
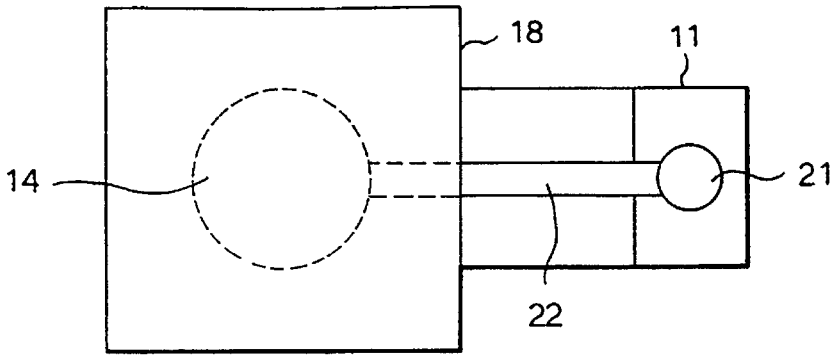
FIGS. 2A and 2B are a top plan view and an elevational view of a metal mold installed in the vertical squeeze casting apparatus according to the present invention, respectively.
Figure 2B:
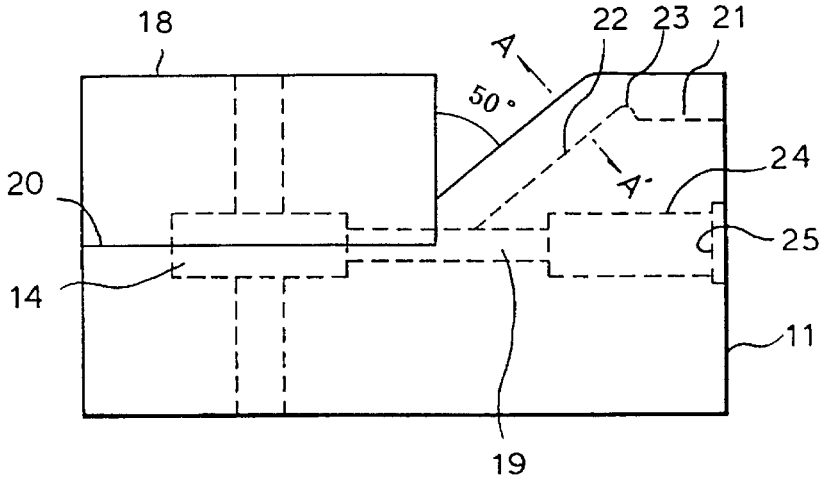

FIGS. 2A and 2B show the metal mold installed in the apparatus for vertical squeeze casting of the present invention. FIG. 2A is a top plan view and FIG. 2B is an elevational view. The metal mold is divided into a movable metal mold 11 and a fixed metal mold 18. The fixed metal mold 18 is installed on the top, and the movable metal mold 11 is installed on the bottom. A molten metal supplying means is installed on a lateral side of the movable metal mold 11 and thus, the movable metal mold 11 has a more complicated structure than the fixed metal mold 18.

Figure 3:
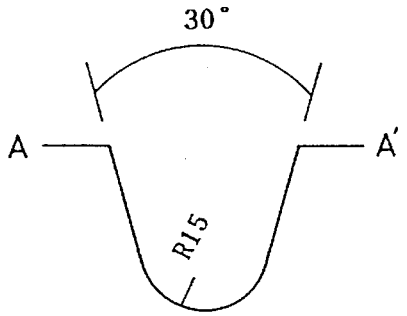
FIG. 3 is a sectional view taken along the line A—A of FIG. 2B showing a shape of the runner.

The movable metal mold 11 and the fixed metal mold 18 both have one side with an accurate metal mold shape in the form of the desired product. Thus, when the movable metal mold 11 and the fixed metal mold 18 are combined, a metal mold cavity 14, with the same shape as the desired product, is formed, forming a molten metal supply inlet 19 on one lateral side. On the split plane of said metal molds, a gap of approximately 0.1–0.5 mm is provided through an air vent 20, so that the air existing within metal mold cavity 14 before the molten metal is filled will leave the metal mold when the molten metal is filled. Particularly, as a molten metal supplying means, a molten metal pool 21 and a runner 22 are provided on the movable metal mold 11. On the molten metal pool 21, a cylindrical groove with a diameter of 50 mm is provided so that it can contain the molten metal supplied by a molten metal ladle (not shown in the figures). The slope of the runner 22 is set at 50 degrees; as shown in FIG. 3, the shape of the lower cross-section is comprised of a half-circle with a center point with a radius of 15 mm and side walls sloped at an angle of 30 degrees laterally. The width of the runner 22 is set at a maximum of 30 mm so that when the molten metal is flowing towards the molten metal supply inlet 19, the molten metal will not splatter out of the runner 22. Further, a small molten metal dam 23 is provided between the molten metal pool 21 and the runner 22 so that the vortex flow of the molten metal when supplied to the molten metal pool 21 by the molten metal ladle, is changed into the laminar flow when flowing into the runner 22, thus maintaining a stable injection rate. On one lateral side of the movable metal mold 11, the lateral pressing cylinder 24 is securely installed, within which the lateral pressing piston 25 moves in a left-to-right direction in the figure through a maximum of 30 tons of pressure. The lateral pressing plunger 26 is connected to the lateral pressing piston 25, and the supplied molten metal in the runner 27 is injected at a low rate into the metal mold cavity 14 by the lateral pressing plunger 26, following the change in movement of the lateral pressing piston 25 in a left direction to the figure. Thus, the lateral pressing at high pressures is effected.

The following, referring to FIGS. 4A through 4F, is a detailed explanation of the process for manufacturing a cast product using the apparatus for vertical squeeze casting of the present invention.

Figure 4A:
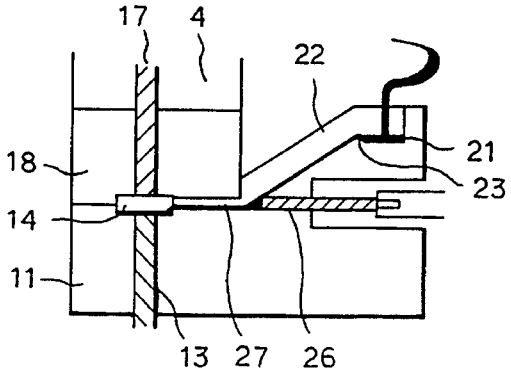
FIG. 4A is a sectional view of the metal mold in the vertical squeeze casting apparatus of the present invention showing the process for supplying the molten metal through a molten metal pool and the runner into a metal mold cavity by using a molten metal ladle.
Figure 4B:
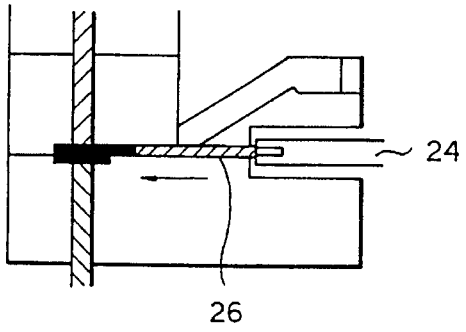
FIG. 4B is a sectional view of the metal mold in the casting apparatus of the present invention showing the state wherein the molten metal fills the metal mold cavity by advancing a lateral pressing plunger.

As shown in FIGS. 1 and 4A, the metal mold engaging piston 6 is moved upwards by activating the hydraulic cylinder 5. Thus, the movable metal mold 11 remains attached to the fixed metal mold 18. Additionally, the front portion of the lateral pressing plunger 26 is placed at the right of the pouring inlet of runner 27, and afterwards, using a molten metal ladle (not shown in the figures), the molten metal is poured into the molten metal pool 21. When the height of the molten metal exceeds that of the molten metal dam 23, the molten metal passes the molten metal dam 23, through the runner 22, and as shown in FIG. 4B, fills the runner 27 and the metal mold cavity 14.

Once the molten metal injection into the runner 27 is completed, the lateral pressing cylinder 24 is activated and the lateral pressing plunger 26 is forwardly moved within said runner. Simultaneously, the molten metal passes through said pouring inlet and is injected at a low rate into the metal mold cavity 14. Also at the same time, the air that was existing in the metal mold cavity 14 is pushed by the molten metal being pushed into said metal mold cavity 14 and is extruded outwardly into the atmosphere through the air vent 20.

Afterwards, once the injection of the molten metal into said metal mold cavity is complete, through an electric signal from an electric circuit (not shown in the figures), a greater amount of pressure is applied through a hydraulic pipe located at the lateral pressing cylinder 24, and lateral pressing is continually applied with the increased pressure until solidification is completed.

Figure 4C:
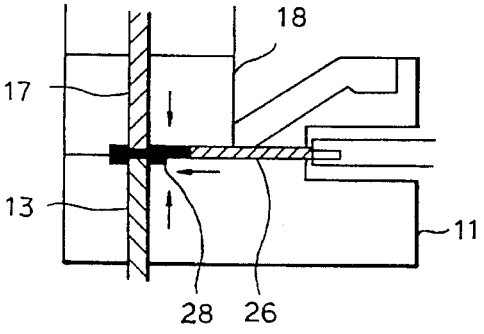
FIG. 4C is a sectional view of the metal mold in the casting apparatus of the present invention showing the state wherein the molten metal in the metal mold cavity is locally pressed during the solidification thereof by advancing the lateral pressing plunger, upper pressing plunger and lower pressing plunger toward the molten metal in the metal mold cavity.

Once lateral pressing is completed as described above, a timer is activated from an electric signal. After a predetermined amount of time passes, a predetermined amount of pressure is applied through the hydraulic pipe located at the upper pressing cylinder 15. Thus, as shown in FIG. 4C, the upper pressing plunger 17 is moved towards the metal mold cavity 14 and the upper local pressing is accomplished. Simultaneously, a predetermined amount of pressing is applied from the lower pressing cylinder 7, thus moving the lower pressing plunger 13 towards the metal mold cavity 14, and accomplishing the lower local pressing upon the already-partially solidified molten metal 28.

Figure 4D:
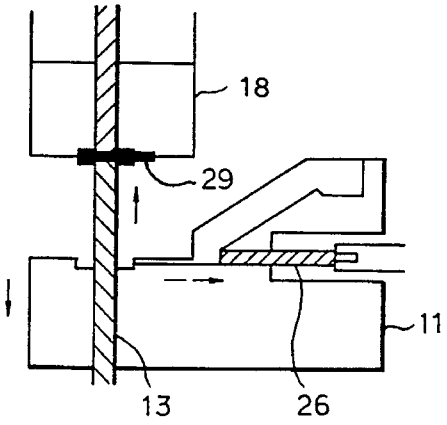
FIG. 4D is a sectional view of the metal mold in the casting apparatus of the present invention showing the status wherein a cast product in the metal mold is remaining attached to the upper fixed metal mold by lowering the lower movable mold and simultaneously further advancing the lower pressing plunger in pressed state as the first step for extracting the completely-formed cast product.

Continuing, once the molten metal inside the metal mold cavity 14 is completely solidified; the following procedures are effected, as shown in FIG. 4D, to extract the completely-solidified cast product 29, without separately providing an extracting means for the extraction of completely-solidified cast product 29. Once the molten metal injected into the metal mold cavity 14 is completely solidified, the movable metal molding supporting means 3 is initially moved to a lower movable metal mold 11. At the same time, the lower pressing plunger 13 is further moved to a higher vertical position, using the lower pressing cylinder 7. Thus, the cast product 27 is separated from movable metal mold 11, while remaining affixed to the fixed metal mold 18. At this time, the lateral pressing plunger 26 is moved in a right direction in the figure so as to move it back to its original position before it applies the pressure.

Figure 4E:
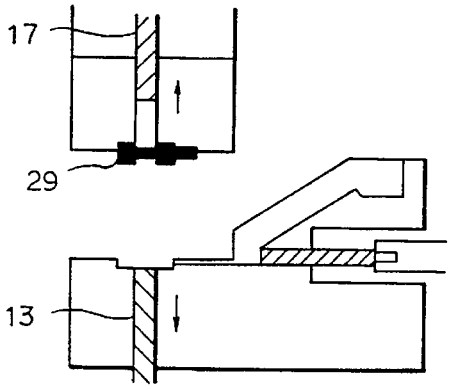
FIG. 4E is a sectional view of the metal mold in the casting apparatus of the present invention showing the state wherein the upper pressing plunger is raised to separate it from a cast product.
Figure 4F:
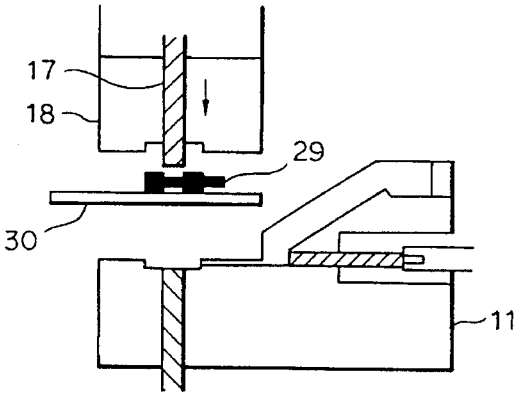
FIG. 4F is a sectional view of the metal mold in the casting apparatus of the present invention showing the state wherein the upper pressing plunger is lowered to separate the cast product from the upper metal mold to the cast product extracting means.
Figure 5A:
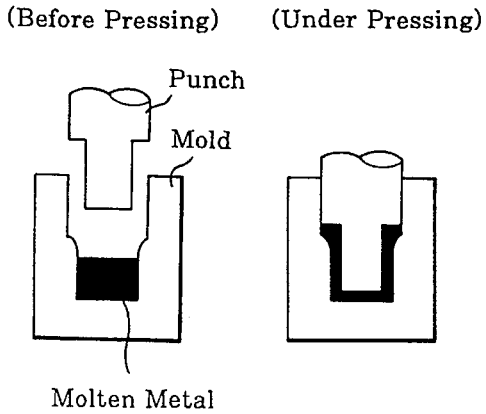
Fig. 5A (Prior Art)
FIGS. 5A to 5C are a sectional views showing the positions of the metal mold and the pressing plunger of the prior art squeeze casting apparatuses classified into different pressing methods, shown in FIG. 5A to 5C as being the direct pressing method, indirect pressing method and local pressing method, respectively.
Figure 5B:
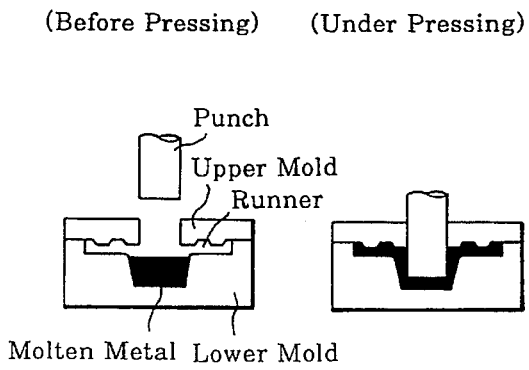
Fig. 5B (Prior Art)
Figure 5C:
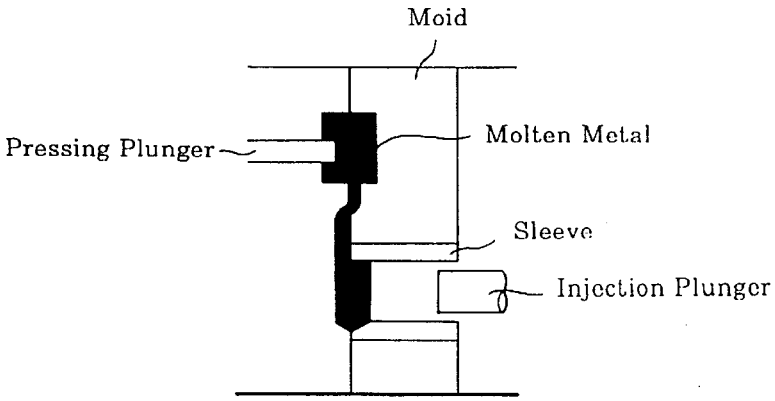
Fig. 5C (Prior Art)

Continuing, as shown in FIG. 4E, the upper pressing plunger 17 is raised to separate it from the cast product, and the lower pressing plunger 13 is moved downwards to also separate it from the cast product, continuing said downward motion until the lower pressing plunger also returns to its original position. Thereafter, as shown in FIG. 4F, cast product extracting means 30 is moved to be under said cast product. And then, the upper pressing plunger 17 is lowered to push the cast product 29 downwards. Thus, the cast product is separated from the fixed metal mold 18 to the top of the extracting means 30. The upper pressing plunger 17 is then raised again to return it to its initial position before it applies the pressure.

The vertical squeeze casting apparatus of the present invention uses the pressing plungers to extract the cast product from the metal mold, thus allows upper, lower, and lateral pressing. Therefore, the cast products which have a complicated structure and many variations in thickness, and which thus require pressing from all directions, may be manufactured.

What is claimed is:

1. A vertical squeeze casting apparatus to provide local pressing for molten metal filled in a metal mold cavity formed within a metal mold, which comprises:

at least three means for pressing the molten metal within the metal mold cavity in upper, lower, and lateral directions, respectively, at least one of said means for pressing the molten metal ejecting the molten metal after solidification thereof; and a molten metal supplying means which is installed on an upper portion of at least one of the pressing means and supplies the molten metal through a hole passing through the metal mold.

2. The apparatus of claim 1, wherein said pressing means comprises:

upper, lower, and lateral pressing plungers reciprocately moveable across the metal mold cavity and passing through and respectively extending from top, bottom, and lateral surfaces of said metal mold to said metal mold cavity; and upper, lower, and lateral pressing pistons respectively activating each of said plungers.

3. The apparatus of claim 1 or 2, wherein said molten metal supplying means comprises a runner sloped at an angle of 45 to 55 degrees from a split plane of the metal mold, a molten metal pool located at the upper end of said runner, and a dam provided therebetween.

4. A vertical squeeze casting apparatus providing local pressing or molten metal filled in a metal mold cavity formed within a metal mold, which comprises:

at least three mechanisms compressing the molten metal within the metal mold cavity in upper, lower and lateral directions, respectively, at least one of said mechanisms pressing the molten metal ejecting the molten metal after solidification thereof; and a molten metal supply mechanism which is installed on an upper portion of at least one of the pressing mechanisms, said supplying mechanism supplying the molten metal through a hole passing through the metal mold.

5. The apparatus of claim 4, wherein said pressing mechanism comprises:

upper, lower and lateral pressing plungers moveable across the metal mold cavity and passing through and respectively extending from top, bottom and lateral surfaces of said metal mold to said metal mold cavity; and upper, lower and lateral pressing pistons respectively activating each of said plungers.

6. The apparatus of claims 4 or 5, wherein said molten metal supply mechanism comprises a runner sloped at an angle of 45° to 55° from a split plane of the metal mold, a molten metal pool located at the upper end of said runner and a dam provided therebetween.

* * * * *